US011235945B2

(12) United States Patent
Hiepp et al.

(10) Patent No.: US 11,235,945 B2
(45) Date of Patent: Feb. 1, 2022

(54) DEVICE AND METHOD FOR DETERMINING THE DIAMETER OF A YARN BALLOON FORMED BY A CONTINUOUS YARN AT A WORKSTATION OF A YARN BALLOON FORMING TEXTILE MACHINE

(71) Applicant: Saurer Technologies GmbH & CO. KG, Krefeld (DE)

(72) Inventors: Magnus Hiepp, Kempten (DE); Walter Pede-Vogler, Durach (DE); Alexander Thaler, Burggen (DE)

(73) Assignee: Saurer Technologies GmbH & CO. KG, Krefeld (DE)

( * ) Notice: Subject to any disclaimer, the term of this patent is extended or adjusted under 35 U.S.C. 154(b) by 423 days.

(21) Appl. No.: 15/409,072

(22) Filed: Jan. 18, 2017

(65) Prior Publication Data

US 2017/0217717 A1 Aug. 3, 2017

(30) Foreign Application Priority Data

Feb. 2, 2016 (DE) ..... 10 2016 001 099.1

(51) Int. Cl.
*B65H 63/028* (2006.01)
*D01H 13/10* (2006.01)
(Continued)

(52) U.S. Cl.
CPC ..... *B65H 63/028* (2013.01); *B65H 49/02* (2013.01); *B65H 59/00* (2013.01); *B65H 63/00* (2013.01);
(Continued)

(58) Field of Classification Search
CPC .... D01H 13/104; D01H 13/106; B65H 59/00; B65H 63/028
See application file for complete search history.

(56) References Cited

U.S. PATENT DOCUMENTS 2,851,848 A * 9/1958 Vibber ..... D01H 1/101 57/58.55
4,399,648 A * 8/1983 Kato ..... D01H 13/26 250/559.29
(Continued)

FOREIGN PATENT DOCUMENTS

DE 2255663 A1 5/1974
DE 195 11 527 A1 10/1996
(Continued)

*Primary Examiner* — Shaun R Hurley
(74) *Attorney, Agent, or Firm* — Nelson Mullins Riley & Scarborough LLP

(57) ABSTRACT

A device as well as a method for determining the diameter of a yarn balloon (B) formed by a continuous yarn at a workstation (1) of a yarn balloon forming textile machine. The workstation (1) comprises an electromagnetically functioning sensor means (33), designed and arranged in such a way that at least two interruptions of a measuring beam (42) of the sensor means (33) are caused by the yarn (5, 25) forming the yarn balloon (B) during every rotation of the yarn balloon (B) during the operation of the workstation (1), and in that the time interval between the interruptions of the measuring beam (42) can be recorded by the sensor means (33) and used for calculating the diameter of the yarn balloon (B).

10 Claims, 4 Drawing Sheets

(51) Int. Cl.

| | |
|---|---|
| ***B65H 59/00*** | (2006.01) |
| ***B65H 49/02*** | (2006.01) |
| ***B65H 63/00*** | (2006.01) |
| ***B65H 63/08*** | (2006.01) |
| ***D01H 7/18*** | (2006.01) |
| ***D01H 1/42*** | (2006.01) |

(52) U.S. Cl.
CPC ..... *B65H 63/082* (2013.01); *D01H 13/104* (2013.01); *B65H 2701/31* (2013.01); *D01H 1/425* (2013.01); *D01H 7/18* (2013.01)

(56) References Cited

U.S. PATENT DOCUMENTS 4,888,944 A * 12/1989 Felix ..... B65H 63/0324 57/264
6,112,508 A * 9/2000 Felix ..... D01H 13/165 57/264
8,256,199 B2 * 9/2012 Schlagenhaft ..... D01H 1/10 57/264
10,000,867 B2 * 6/2018 Hiepp ..... D01H 13/26
2006/0042220 A1 * 3/2006 Maccabruni ..... D02G 1/0266 57/264
2017/0130368 A1 * 5/2017 Raisich ..... D01H 1/103

FOREIGN PATENT DOCUMENTS

| | | | |
|---|---|---|---|
| DE | 199 30 313 | A1 | 1/2001 |
| DE | 101 03 892 | A1 | 8/2002 |
| DE | 10 2015 005 328 | A1 | 10/2016 |
| EP | 0 282 745 | A1 | 9/1988 |
| EP | 2 315 864 | A1 | 5/2011 |
| EP | 2 419 554 | A1 | 2/2012 |

* cited by examiner

DEVICE AND METHOD FOR DETERMINING THE DIAMETER OF A YARN BALLOON FORMED BY A CONTINUOUS YARN AT A WORKSTATION OF A YARN BALLOON FORMING TEXTILE MACHINE

CROSS-REFERENCE TO RELATED APPLICATIONS

This application claims priority from German National Patent Application No. DE 10 2016 001 099.1, filed Feb. 2, 2016, entitled "Vorrichtung and Verfahren zum Ermitteln des Durchmessers eines durch einen laufenden Faden gebildeten Fadenballons an einer Arbeitsstelle einer fadenballonbildenden Textilmaschine", the entire contents of which are incorporated herein by reference.

FIELD OF THE INVENTION

The present invention concerns a device for determining the diameter of a yarn balloon formed by a continuous yarn at a workstation of a yarn balloon forming textile machine as well as an associated method.

BACKGROUND OF THE INVENTION

Various embodiments of production machines, where a yarn balloon is formed in the area of their often numerous workstations or at associated operating means during operation, have been known for a long time within the textile machine industry.

Such production machines therefore comprise monitoring means for determining and limiting the size of these yarn balloons, which can work very differently. Known monitoring means for example often include sensor means with which the circulating yarn, which forms the yarn balloon, is monitored.

A method and a device with which the yarn extraction speed from feed packages arranged at the creel of a warping machine are optimised are for example described in German Patent Publication DE 101 03 892 A1.

A yarn balloon, the diameter of which will depend on the yarn extraction speed and the yarn pulling force amongst other things, is known to occur when a yarn is extracted overhead and at a relatively high extraction speed from a feed package positioned in an associated creel during the working process.

With the method known from German Patent Publication DE 101 03 892 A1 the size of at least some of the yarn balloons created during yarn extraction is recorded and transmitted to a controller by measuring equipment arranged at the creel, will ensure that the regulation of the yarn extraction speed is acted upon when the limit values for the yarn balloons are reached. Measuring equipment for recording the yarn balloon size can be various optically functioning measuring units, for example a camera, one or more light barriers or similar equipment.

The method described in German Patent Publication DE 101 03 892 A1 is however used only for scanning the limit values for the balloon size, but provides no information about the balloon size at all times during the process. This means that a described regulation will be activated only when a stipulated limit value is exceeded or not reached. Regulation is also deactivated when the stipulated values for the maximum extraction speed or the maximum yarn pulling force are reached.

Optically functioning measuring means working in connection with ring spinning machines are also known from German Patent Publication DE 22 55 663 A1 and European Patent Publication EP 0 282 745 A1, with which a yarn balloon shape and/or a yarn balloon size can be recorded.

German Patent Publication DE 22 55 663 A1 for example describes a workstation of a ring spinning machine equipped with an air or magnet mounted spinning ring, on which a spinning reel driven by the continuous yarn circulates.

As a specific difference between the speed of the spinning ring and the speed of the spinning reel is known to be necessary during operation of such workstations in order to guarantee a problem-free spinning process, the speed of the air or magnet mounted spinning ring as well as the speed of the spinning reel are checked during the spinning operation.

It is also continuously checked with this method whether a stipulated maximum yarn tension is maintained, and any yarn balloon created when spinning in the area of the spinning bobbin is checked and stabilised if necessary. This means that the expansion of the yarn curve of the yarn balloon is stabilised by measuring the yarn curve deviation of the yarn balloon from its meridian level and corresponding regulation of the yarn tension by means of variable braking of the spinning ring. The means for recording the yarn curve deviation of the yarn balloon here substantially consists of an encoder comprising a series of small photo elements as well as a trigger means that ensures that the yarn balloon is periodically illuminated.

The known devices are either relatively complicated (German Patent Publication DE 22 55 663 A1) and often also quite inaccurate, or they are very sensitive with regard to air pollution due to their large measuring range (German Patent Publication DE 101 03 892 A1).

In practice these known devices have thus not been able to prove themselves.

European Patent Publication EP 0 282 745 A1 describes a method or a device for the production and quality monitoring of workstations of a multi-spindle textile machine, which means a method and a device with which the presence of the yarns and yarn diameters are monitored.

A ring spinning machine is equipped with an optical monitoring organ for this purpose, which simultaneously checks a multitude of workstations of the textile machine arranged next to each other in series in that yarn balloons rotating in the area of the workstations are illuminated.

The monitoring organ comprises a transmitter and a receiver for this purpose, which are designed and arranged in such a way that a beam bundle emitted by a transmitter travels through the numerous circulating yarn balloons on its way to the receiver and is therefore intermittently interrupted or weakened by the yarn balloons.

This shading is converted into an electric signal in the receiver, which is used as the basis for further evaluation in an associated regulator.

The method described in European Patent Publication EP 0 282 745 A1 also occasionally works rather imprecisely, as the beam bundle is often negatively influenced by fiber and dust particles, which are almost unavoidable in the atmosphere of a spinning room, on its way from the transmitter to the receiver. The chosen arrangements of the monitoring organ also do not allow a conclusion with regard to the balloon diameters.

A workstation of a double-wire twisting and cabling machine, the spooling and winding means of which is arranged in such a way that it lies within a yarn balloon ruing operation, is also known from European Patent Publication EP 2 419 554 B1.

The workstation comprises a monitoring means that can comprise various embodiments to be able to control the size of the yarn balloon. The monitoring means can for example work either indirectly or optically.

The size of the yarn balloon can for example be determined indirectly via a yarn tension sensor, which is arranged either between a yarn drive means and the inlet of the yarn into a spindle, which ensures the creation of the yarn balloon, or by means of a yarn tension sensor positioned between the outlet of the yarn from the spindle and a further yarn drive means.

In a further embodiment, recording the size of the yarn balloon can also be realised indirectly by measuring the performance or the torque of the drive means of the spindle. This means that the current absorbed by the spindle drive is determined with a measuring means and the size of the yarn balloon deduced from this in an evaluation means.

With regard to optical measuring means that monitor the yarn balloon circling the spooling and winding means, the use of at least two light barriers, comprising a light source for emitting a light beam and a light-sensitive detector for recording the light beam, is suggested in a first embodiment. With such a means the interruption of the light beam by the passing yarn of the yarn balloon is detected during operation. However, the known embodiment is used only for scanning the limit values for the balloon size and gives no exact indication of the size of the yarn balloon at any time of the spooling process.

In a further comparable embodiment a light sensor of the type CCD is used in combination with a beam-like, stroboscopic light source, for example an LED or laser.

With the means that acts with a light sensor and a stroboscopic light source synchronised by turning the spindle the image, and with it the shape of the yarn forming the yarn balloon, is localised when it is illuminated by the flash.

With such an embodiment different reflections are however possible, depending on the yarn thickness, yarn surface and/or yarn twists, which negatively influence the error quota and resolution of the measurement.

CCD receivers also represent relatively costly equipment, as they require a complex evaluation unit for their operation.

The monitoring means described in European Patent Publication EP 2 419 554 B1 in connection with a workstation of a double-wire twisting and cabling machine are all improvable, as they either do not measure precisely enough or are relatively costly.

SUMMARY OF THE INVENTION

Based on the above mentioned prior art the invention is based on the task of developing a method or a device with which the diameter of a yarn balloon formed by a continuous yarn can be determined directly and reliably. The device in question should also be a simple and cost effective as possible.

This task is solved according to the invention in the workstation comprises an electromagnetically functioning sensor means designed and arranged in such a way that at least two interruptions of a measuring beam of the sensor means by the yarn forming the yarn balloon occur during the operation of the workstation during every rotation of the yarn balloon, and in that the time gap between the interruptions of the measuring beam are recorded and used for calculating the diameter of the yarn balloon.

Advantageous embodiments of the method according to the invention as well as device for implementing the method are described more fully hereinafter.

The device according to the invention in particular has the advantage that the diameter of the yarn balloon is monitored continuously from an adjustable minimum balloon size at every workstation of the yarn balloon forming textile machine.

The design and arrangement of the sensor means according to the invention thereby carries out a direct, immediate determining of the diameter of the yarn balloon. This means that the always directly and correctly determined yarn balloon size is transmitted reliably and exactly for evaluation to a downstream means, which initiates regulating measures if required, preferably in connection with the yarn tension of the outer yarn.

Use of the sensor means according to the invention is cost effective and also enables a compact construction of the workstation with the consequence that the space requirement needed for erecting a double-wire twisting or cabling machine is reduced.

The sensor means according to the invention is not only relatively cost effective, but also has, as already indicated above, very high sensitivity and rapid reaction, so that the circulating yarn balloon is always scanned quickly and reliably.

The sensor means can also, as is known from German Patent Publication DE 199 30 313 A1, have a solar cell as well as feedback between the transmitter and the receiver. Such feedback balances out possible errors due to soiling, ageing etc. that may occur in the system.

In one advantageous embodiment it is envisaged that the sensor means is designed as an optically functioning light barrier, comprising a light source and a light receiver. Such light barriers are proven construction elements for textile machine construction, of which relatively large numbers are used within the textile industry. This means that such construction elements are not only very reliable during the operation, but also have a long working life. Thanks to their large numbers such construction elements are also relatively cost effective.

The light barrier can either be constructed as a one-way light barrier here, where the light source and the light receiver are arranged on opposite sides of the yarn balloon to be monitored, or are designed as a reflection light barrier, where the light source and the light receiver are installed on the same side of the yarn balloon to be monitored.

With reflection light sources the light source and the light receiver can either be arranged in a common sensor housing or in separate housings, wherein an additional reflector does however need to be installed in both cases, which is for example arranged on the opposite side of the yarn balloon in relation to the sensor housing and reflects the light beam of the light source back to the light receiver.

Both embodiments of light barriers are known and have long proven themselves for textile machine construction.

The sensor means according to the invention does not necessarily have to function optically with a measuring beam based on a light/laser beam. It is also possible to use a measuring beam that works on another basis of the electromagnetic spectrum.

The measuring beam can for example also be initiated by an ultrasound, induction, heat source etc. or its interferences, wherein a corresponding associated receiver is then also used.

In an advantageous embodiment it is further envisaged that a light emitting diode is used as the light source. Such diodes, called LED for short by the experts, are characterized by high luminosity, a long working life and very low energy consumption.

In principle the use of other illuminants as a light source is however also feasible in connection with the sensor means according to the invention.

A laser diode or a surface emitter=VCSEL could for example also be used as a light source. These illuminants also each have special advantages.

When using a light barrier it is also of advantage if the light receiver has a receiver diode that is for example designed as a photodiode. However, a phototransistor or a photoconductive cell can also be used as a light receiver.

A photodiode is known to react very sensitively to fluctuations in brightness. If the light beam emitted by the light source is for example interrupted by a yarn, the lowered illumination strength is immediately registered by the photodiode. This means that the electric conductivity of the photodiode falls, which is transmitted as an electric signal to a downstream means.

Various designs are possible for the arrangement of the sensor means according to the invention. Scanning the yarn balloon can for example be carried out orthogonally or parallel to the axis of rotation of the spindle, and therefore to the axis of rotation of the yarn balloon. However, an arrangement of the sensor means where the measuring beam extends neither orthogonally nor parallel to the axis of rotation of the yarn balloon, but at an angle, is also possible in principle.

One advantageous embodiment is also given when the sensor means, as it known from German Patent Publication DE 195 11 527 A1, is arranged at the height of the encoding triangle of the workstation and designed as a light barrier. In such a case the deviations of the twisted yarn after the triangle or the yarns directly before the triangle up to the axis of rotation of the yarn balloon provide information about a possible overlength in the cord (twisted yarn). This means that the balloon sleeve/balloon contour can not only be optimally determined if several devices for monitoring a yarn balloon are used at a spindle, but the generation of overlengths can also be simultaneously monitored in connection with the encoding triangle.

In another advantageous embodiment it is however also feasible that the sensor means is arranged in such a way that the light beam of the sensor means extends parallel to and at a distance from the axis of rotation of the spindle, and therefore to the axis of rotation of the yarn balloon.

The sensor means can also be arranged in such a way that the light beam extends at an angle to the axis of rotation of the yarn balloon that is >90° and <180°.

Which of the above embodiments are used in the end normally depends on the relevant space requirements at the workstations of the yarn balloon forming textile machine, or even on the yarn type/yarn type to be processed.

In order to be able to rule out errors caused by the absence of, for example spindle parts, or the inner yarn and for example depict a complete balloon shape when scanning the yarn balloon on a downstream monitor, the most suitable embodiment should be selected in each case.

It is however important in this respect that the upcoming line of action of the measuring beam between the light source and the light receiver does not cross the central line of the yarn balloon, which is preferably formed by the axis of rotation of the yarn balloon.

BRIEF DESCRIPTION OF THE DRAWINGS

The invention will now be explained in more detail with reference to various embodiment examples illustrated in the drawings, wherein.

DETAILED DESCRIPTION OF THE INVENTION

Figure 1:
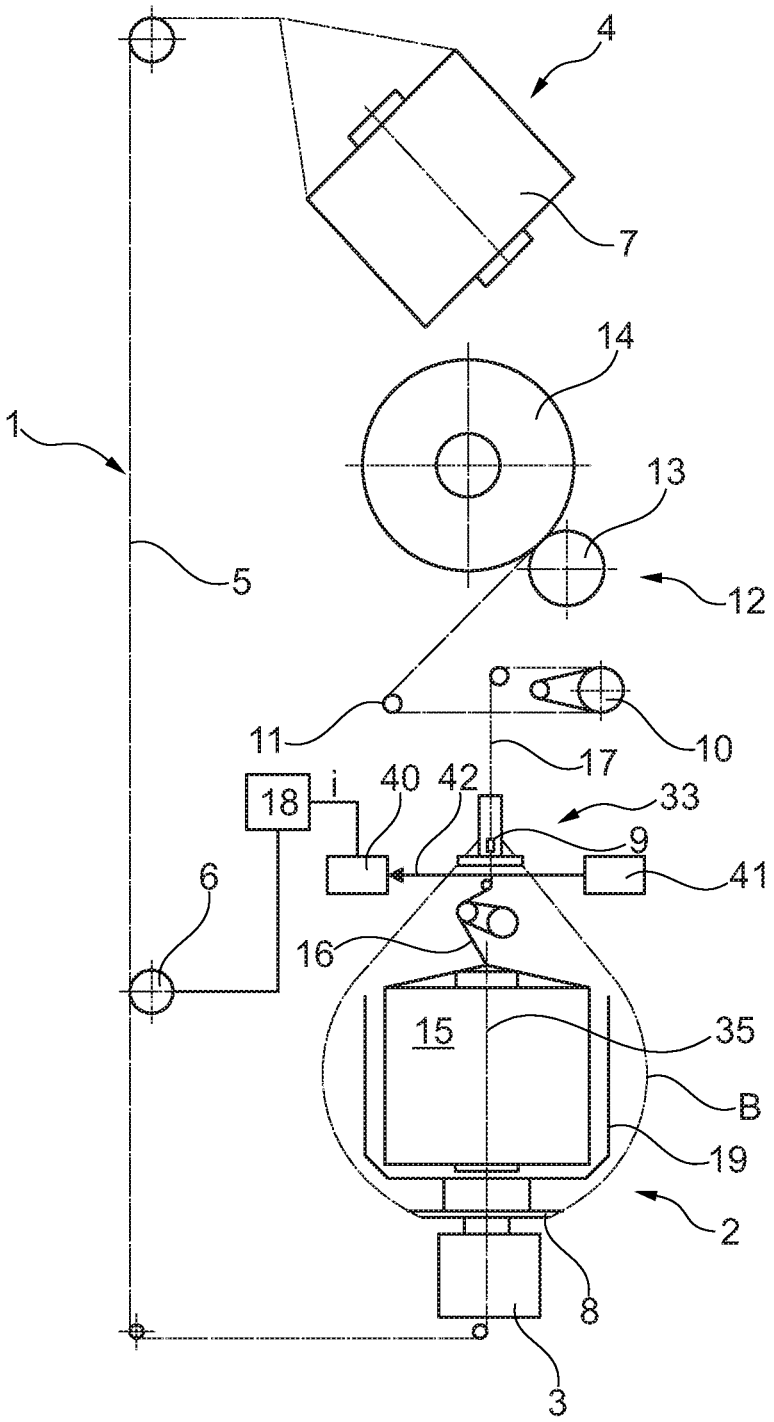
FIG. 1 is a schematic side view of a workstation of a double-wire twisting or cabling machine with a sensor means according to the invention, arranged in such a way that the measuring beam of the sensor means extends orthogonally to the axis of rotation of the spindle.

A schematic side view of a workstation 1 of a double-wire twisting or cabling machine is illustrated in FIG. 1. In this embodiment the textile machine comprises a creel 4, which is normally positioned above or behind the workstation 1 and normally serves for receiving a multitude of feed packages. A so-called outer yarn 5 is extracted from one of the feed packages, hereafter described as the first feed package 7.

The workstation 1 further has a spindle 2, rotatable around an axis of rotation 35, in the present embodiment example consisting of a cabling spindle equipped with a protective cap 19, in which a second feed package 15 is stored.

A so-called inner yarn 16 is extracted overhead from this second feed package 15, and is supplied to a yarn balloon guiding eye or a so-called balancing system 9 arranged above the spindle 2. The protective cap 19, mounted on the yarn diverting means designed as a rotatable twisted yarn plate 8 in this embodiment example, is preferably secured against rotating by a magnetic means (not shown). The yarn diverting means of the spindle 2 is activated by a spindle drive 3, which can either be a direct drive or an indirect drive.

The outer yarn 5 extracted from the first feed package 7 is supplied to a controllable means 6 arranged in the yarn path between the creel 4 and the spindle 2 for influencing the yarn supply speed or the yarn tension, with which the yarn tension of the outer yarn 5 can be varied if necessary.

The means 6 is connected with a control circuit 18 via control lines, which regulate the yarn tension and/or the yarn supply speed applied to the outer yarn 5 by the means 6.

The controllable yarn tension applied to the outer yarn 5 by the means 6 is here preferably of a magnitude that, depending on the geometry of the spindle 2, leads to an optimisation of the free yarn balloon B, i.e. to a yarn balloon B with the smallest possible diameter.

After the means 6 the outer yarn 5 runs through the spindle drive 3 in the area of the axis of rotation of the spindle drive 3, and exits the hollow axis of rotation of the spindle drive 3 in a radial direction below the twisted yarn plate 8 through a so-called yarn output bore. The outer yarn 5 then runs to the outer area of the twisted yarn plate 8.

With the present embodiment example the outer yarn 5 is diverted upwards at the edge of the twisted yarn plate 8 and circles the protective cap 19 of the spindle 2, in which the second feed package 15 is positioned, whilst forming a free yarn balloon B.

A sensor means 33 is further arranged above the protective cap 19 of the spindle 2, which is for example designed as a light barrier.

For this the sensor means 33 can either, as illustrated in the figures, be designed as a one-way light barrier, where a light source 41 and a light receiver 42 are arranged on opposite sides of the yarn balloon B to be monitored, or as a reflection light barrier (not shown), where the light source 41 and the light receiver 40 are positioned on the same side of the yarn balloon to be monitored, and are for example arranged in a common sensor housing.

With a reflection light barrier the light beam of the light source is also reflected back to the light receiver by a reflector, arranged on the opposite side of the yarn balloon B to be monitored in relation to the sensor housing.

As is clear, the one-way light barrier of the embodiment example illustrated in FIG. 1 is positioned in such a way that a measuring beam 42 emitted by the light source 41 of the sensor means 33, in this case a light beam, passes through the area of the yarn balloon B orthogonally to the axis of rotation of the spindle 2 and meets the associated light receiver 40 of the sensor means 33. The light receiver 40 of the sensor means 33 is also connected with a control circuit 18 via a signal line here.

The sensor means 33, with which the relevant current actual diameter of the yarn balloon B to be monitored is determined, does however not necessarily have to function as a light barrier, but can in principle also work according to another physical principle.

The sensor means 33 can for example also work with any other wavelength of the electromagnetic spectrum, for example radar, ultrasound, infrared etc.

In the present embodiment example the sensor means 33 according to the invention is however designed as an optically functioning light barrier, comprising a light source 41 and a light receiver 40. Light emitting diodes=LEDs, laser diodes or surface emitters=VCSELs can for example be used as the light source 41. A photodiode, a phototransistor or a photoconductive cell can also be used as a light receiver 40.

As is also clear from FIG. 1, the outer yarn 5 extracted from the first feed package 7 and the inner yarn 16 extracted from the second feed package 15 are joined in the area of a yarn balloon guiding eye or a balancing system 9, wherein the position of the yarn balloon guiding eye or the balancing system 9 determines the height of the free yarn balloon B that is formed.

The so-called cabling or also cording point is located in the yarn balloon guiding eye or the balancing system 9, in which the two yarns, the outer yarn 5 and the inner yarn 16, come together and for example form a cord yarn 17.

A yarn extraction device 10 with which the cord yarn 17 is extracted and supplied to a spooling and winding device 12 via a balancing element, such as for example a compensating means 11, is arranged above the cabling point.

The spooling and winding device 12 here comprises a drive cylinder 13, as is usual, which drives a spool 14 by means of friction.

The means 6 for influencing the yarn tension is either designed as an electronically regulated brake or as an active supply mechanism, wherein a combination of the two above mentioned components can also be used.

A galette, a serrated lock washer or a drive roll with a corresponding pressure roll are for example possible as design variations of a supply mechanism.

The means 6 regulates the yarn tension of the outer yarn 5 depending on the diameter of the free yarn balloon B, which is determined by the sensor means 33. This means that a measuring beam 42 initiated by the light source 41 of the sensor means 33 is crossed twice by the running outer yarn 5 forming the rotating yarn balloon B at every rotation of the yarn balloon B during the operation of the workstation 1, which is immediately recognised as a fault S in form of a shadow by the light receiver 40 of the sensor means 33 and transmitted to the control circuit 18 as an electric signal i.

The control circuit 18 then immediately calculates the current actual diameter of the yarn balloon B from the time gap between the two faults S, and therefore the electric signals i generated by the light receiver 40 of the sensor means 33 at every rotation of the yarn balloon B. The control circuit 18 also immediately acts to regulate the yarn supply speed of the outer yarn 5 via the means 6 if necessary, which immediately leads to a correction of the diameter of the circulating yarn balloon B.

As already indicated above, the sensor means 33 is designed as a light barrier in the embodiment example illustrated in FIG. 1, or more precisely as a one-way light barrier. This means that the sensor means 33 comprises a light course 41 and a light receiver 40 arranged on the opposite side of the yearn balloon B to be monitored, wherein the light source 41 and the light receiver 40 are arranged in such a way that a light beam originating from the light source 41, serving as a measuring beam 42, penetrates the rotating yarn balloon B.

The measuring beam 42 of the sensor means 33 here extends orthogonally to the axis of rotation of the yarn balloon B, so that the yarn balloon B, formed by the outer yarn 5 in the present embodiment example, intersects the measuring beam 42 twice during each rotation. The measuring beam 42 is this interrupted or weakened, which leads to varying irradiation intensity at the light receiver 40, with the consequence of a change in its voltage.

Figure 2:
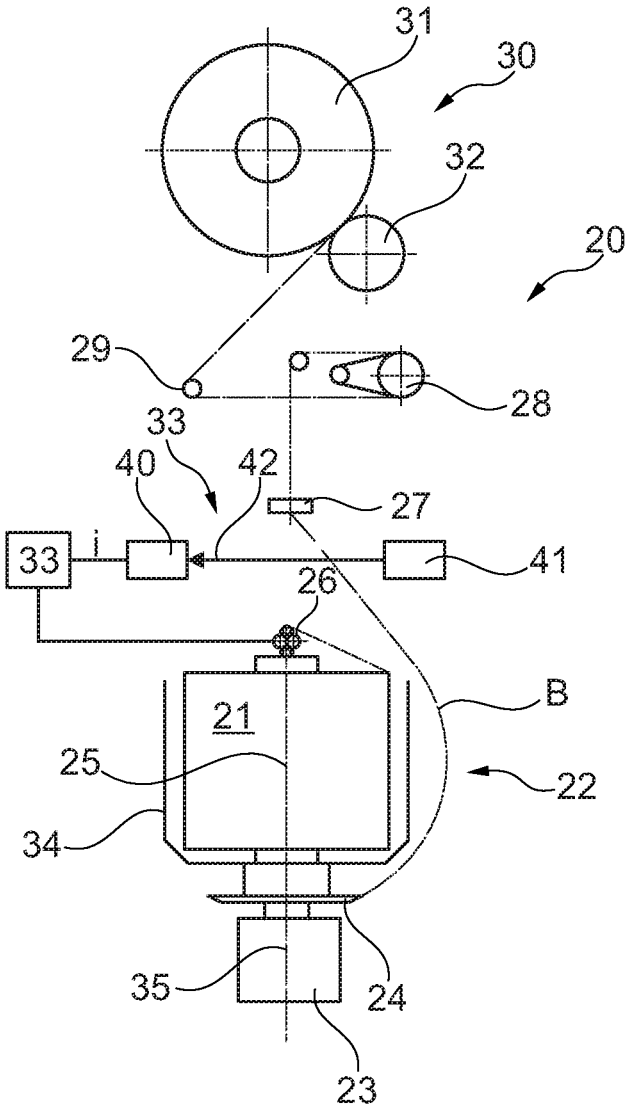
FIG. 2 is a schematic side view of a workstation of a double-wire twisting machine with a sensor means according to the invention, also arranged in such a way that the measuring beam of its sensor means extends orthogonally to the axis of rotation of the spindle.

The basic construction of the workstation 20 of a double-wire twisting machine illustrated as an embodiment example in FIG. 2 has long been known and is for example described in detail in European Patent Publication EP 2 315 864 B1.

As is clear, the workstation 20 comprises a twisted yarn spindle 22, driven by a spindle drive 23 and rotatable around an axis of rotation 35. The twisted yarn spindle 22 has a protective cap 34, in which a feed package 21 is located, from which a yarn 25 is extracted by means of a yarn tension influencing device 26. The yarn tension influencing device 26 is connected with a control circuit 33 via a control line. The yarn 25 then arrives at a balloon yarn guiding eye 27 arranged above the yarn tension influencing device 26 via a yarn deflection means 24, preferably designed as a twisted yarn plate connected with a spindle drive 23. The balloon yarn guiding eye 27 is followed by a yarn extraction device 28, a balancing element such as for example a compensating means 29, and a spooling and winding device 30. The spooling and winding device 30 here comprises a drive cylinder 32 as is usual, which drives a spool 31 by means of friction.

The workstation 20 further has a sensor means 33, designed as a one-way light barrier in the embodiment example, and a light source 41 as well as a light receiver 40, wherein the light receiver 40 is connected with a control circuit 33 via a signal line.

The light source 41 and the light receiver 40 of the sensor means 33 are arranged in such a way here that the measuring beam 42 present as a light beam, initiated by the light source 41 of the sensor means 33, extends orthogonally to the axis of rotation 35 of the twisted yarn spindle 22, and therefore also orthogonally to the axis of rotation of the yarn balloon B.

The measuring beam 42 of the sensor means 33 is consequently crossed twice by the yarn 25 during every rotation of the yarn balloon B, which is immediately recognised as a fault by the light receiver 40 of the sensor means 33 and transmitted to the control circuit 33 as an electric signal i.

This means that each interruption or weakening of the measuring beam 42 of the sensor means 33 designed as a light beam will lead to a deviating irradiation intensity at the light receiver 40 with the sensor means 33 of the present workstation 20 of a double-wire twisted yarn machine with the consequence that the light receiver 40 immediately generated an electric signal I, which is transmitted to the control circuit 33 via the signal line. The control circuit 33 then immediately effects regulation of the diameter of the yarn balloon B via the yarn tension influencing device 26.

Figure 3:
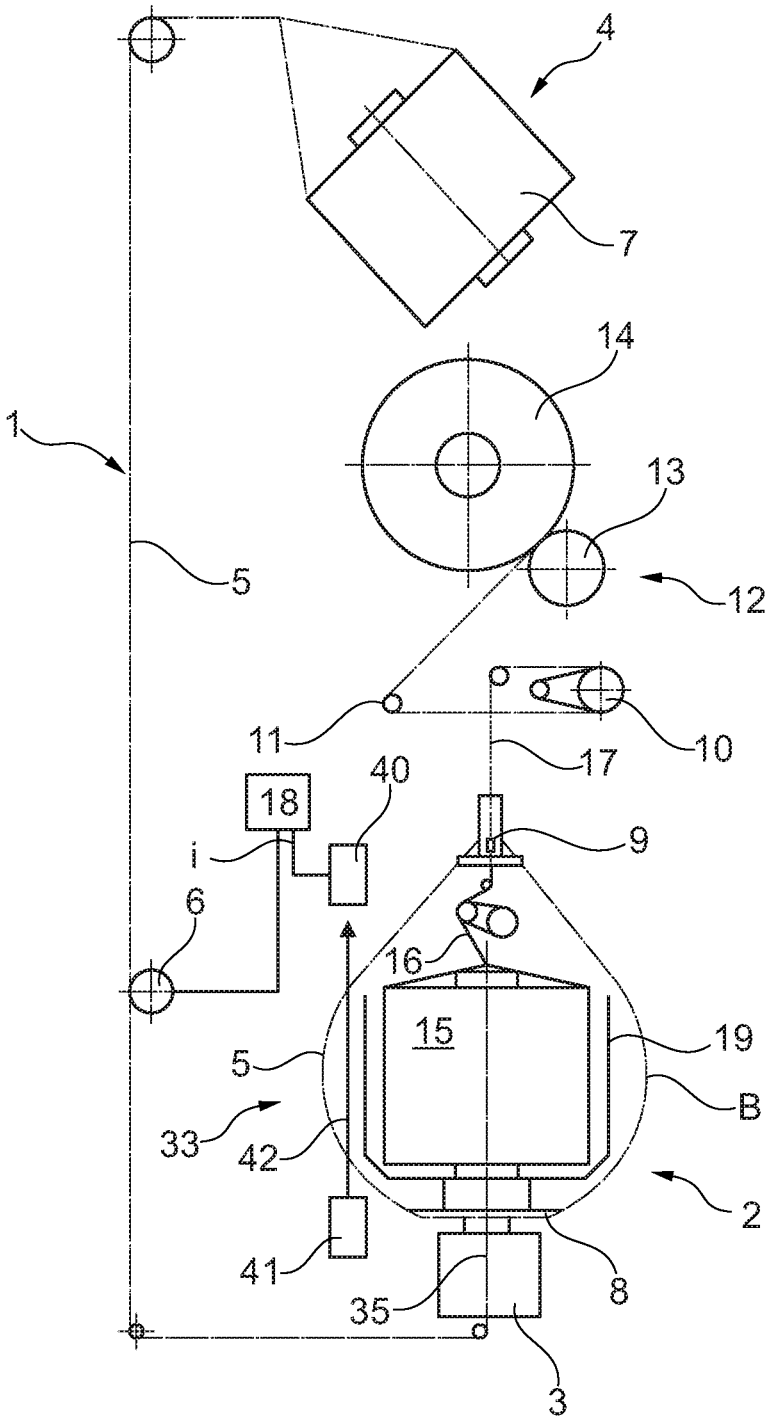
FIG. 3 is a schematic side view of a workstation of a double-wire twisting or cabling machine with a sensor means according to the invention, arranged in such a way that the measuring beam of the sensor means extends parallel to the axis of rotation of the spindle.

The workstation 2 of a double-wire twisted yarn or cabling machine illustrated as an embodiment example in FIG. 3 substantially equals the embodiment example of FIG. 1. The workstation 2 according to FIG. 3 differs only in the arrangement of the sensor means 33.

As is clear, the sensor means 33 designed as a one-way light barrier in the present embodiment example as well is arranged in such a way that the measuring beam 42 of the sensor means 33 extends parallel to the axis of rotation 35 of the spindle 2. This means that the light source 41 and the light receiver 40 are position in such a way that the measuring beams 42 designed as a light beam is arranged parallel to the axis of rotation of the yarn balloon B.

The light beam 42 of the sensor means 33 is interrupted or weakened by the rotating yarn, in this case by the outer yarn 5, during each rotation of the yarn balloon B in this embodiment example as well and thus generates different irradiation intensities at the light receiver 40, which leads to a fault S, and therefore to a change in the electric voltage of the light receiver 40 and is transmitted to the control circuit 18 as an electric signal.

Figure 4A:
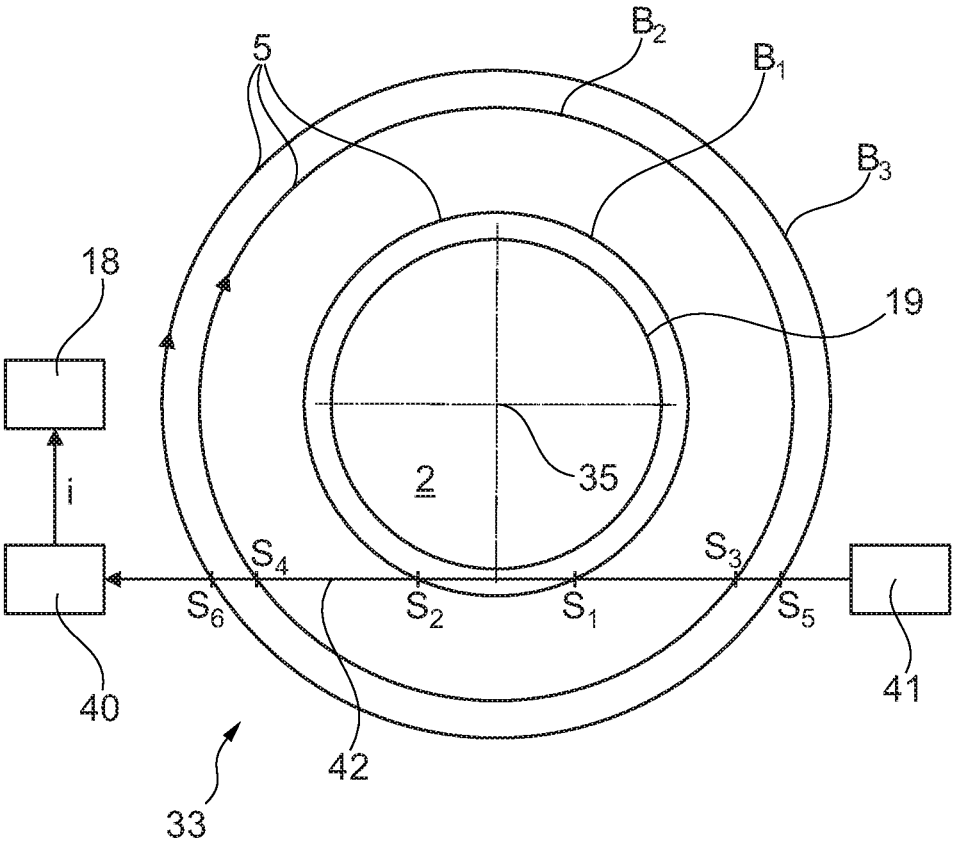
FIG. 4A and FIG. 4B are graphic illustrations of the mode of action of the sensor means according to the invention.
Figure 4B:
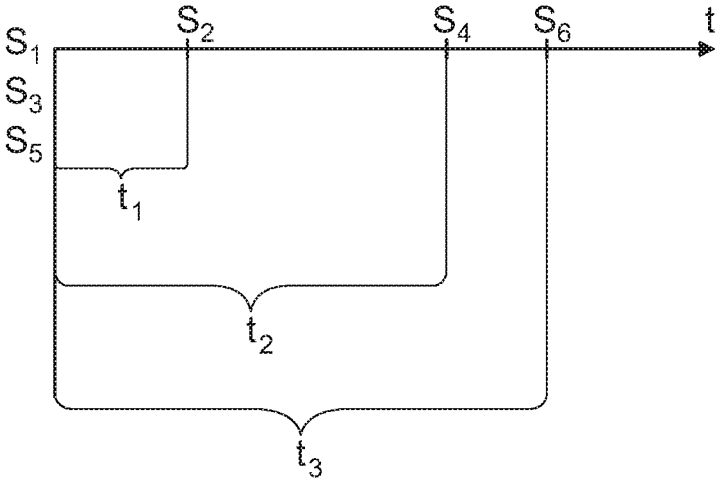

FIGS. 4A and 4B show a graphic illustration of the working method of a sensor means 33 according to the invention.

In the embodiment example according to FIG. 4A the sensor means 33 is designed as a one-way light barrier, which, as is obvious, has a light source 41—for example an LED or a laser—and a light receiver 40, for example a receiver diode. The light source 41 and the light receiver 40 are arranged in such a way here that a measuring beam 42, in this the present embodiment example a light beam, emitted by the light source 41 is interrupted by the yarn, for example an outer yarn 5, forming the yarn balloon B during every rotation of a yarn balloon B, which leads to a measuring impulse at the light receiver 40 and is transmitted to the control circuit 18 as an electric signal i.

The minimally measurable diameter of the yarn balloon B is given with the sensor means 33 according to the invention when the measuring beam 42 is interrupted just once during a rotation of the yarn balloon B and the light receiver 40 generates just one electric signal I=measuring impulse per rotation of the yarn balloon B.

With increasingly larger yarn balloons B the yarn 5 causes two faults S of the measuring beam 42 at different times during each rotation of the yarn balloon B, as is illustrated in FIG. 4A, each detected by the light receiver 40 and transmitted to the control circuit 18 as a measuring impulse i by the same.

As is clear from FIG. 4B, the control circuit 18 calculates the current diameter of the yarn balloon B from the time interval t between the two measuring impulses i and the known distance of the measuring beam 42 from the axis of rotation of the spindle without a problem.

As illustrated in FIG. 4A, a measuring beam 42 emitted by the light source 41 of the sensor means 33 is interrupted twice by a yarn 5 circulating the protective cap 19 of a spindle 2 as a yarn balloon $B_1$ and having a relatively small diameter, which is identified by fault points $S_1$ and $S_2$.

A time interval $t_1$ lies between the fault points $S_1$ and $S_2$, each recognised by the light receiver 40 and transmitted to the control circuit 18 as an electric signal i. The control circuit 18 then immediately calculates the current diameter of the yarn balloon $B_1$ with the aid of this as further known data, as already explained above.

Comparable situations are also given when the spindle 2 is circulated by a yarn balloon B with a clearly larger diameter, i.e. if a yarn balloon $B_2$ or a yarn balloon $B_3$ is present.

In such a case the yarn 5 also initiates two faults of the measuring beam 42 of the sensor means 33 at time intervals during every rotation of the yarn balloon. In FIG. 4A the fault points $S_3$ and $S_4$ relating to the yarn balloon $B_2$ are identified, whilst the fault points affecting yarn balloon $B_3$ are identified with $S_5$ and $S_6$.

As illustrated in FIG. 4B fault points $S_3$ and $_4$ here have a temporary distance $t_2$, whilst fault points $S_5$ and $S_6$ are separated by time interval $t_3$. The current diameters of yarn balloons $B_2$ or $B_3$ can be calculated without a problem from intervals $t_2$ or $t_3$ by means of further data.

A special case is given if the measuring beam 42 of the sensor means 33 is merely tangent to the yarn balloon B, i.e. if only one interruption occurs per rotation of the yarn balloon B.

In such a case the control circuit 18 can also determine the current diameter of the yarn balloon B without a problem with the known arrangement of the sensor means 33.

The device according to the invention or the associated method can preferably also be used in connection with a reference spindle.

This means at least one of the workstations of the yarn balloon forming textile machine is designed as a reference spindle, equipped with a device according to the invention and continuously monitoring the diameter of the yarn balloon.

The values determined by the reference spindle are then used for setting up neighbouring workstations of the textile machine.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. A device for determining the diameter of a yarn balloon formed by a continuous yarn at a workstation of a yarn balloon forming textile machine, characterized in that the workstation comprises a spindle and an electromagnetically functioning sensor, arranged in such a way that at least two faults of a measuring beam of the sensor are generated by the continuous yarn forming the yarn balloon during the operation of the workstation during every rotation of the yarn balloon, and in that the time interval of the faults of the measuring beam can be recorded by the sensor and used for calculating the diameter of the yarn balloon, wherein the sensor is arranged in such a way that the measuring beam of the sensor extends parallel at a distance from the axis of rotation of the spindle.

2. The device according to claim 1, characterized in that the sensor is designed as an optically functioning light barrier with a light source and a light receiver.

3. The device according to claim 2, characterized in that the sensor is designed as a one-way light barrier, with a light source and a light receiver, each arranged on opposite sides of the yarn balloon to be monitored.

4. The device according to claim 2, characterized in that the sensor is designed as a reflection light barrier, with a light source and a light receiver on the same side of the yarn balloon to be monitored, as well as a reflector member for the functional connection of the light source and the light receiver.

5. The device according to claim 2, characterized in that a light emitting diode is used as a light source.

6. The device according to claim 2, characterized in that a laser is used as a light source.

7. The device according to claim 2, characterized in that the light receiver has a receiver diode.

8. A method for determining the diameter of a yarn balloon formed by a continuous yarn at a workstation of a yarn balloon forming textile machine with a device according to claim 1, characterized in that intermittent faults of the measuring beam of the sensor caused by the continuous yarn during the operation of the workstation during every rotation of the yarn balloon are each converted into an electric signal (i) by the sensor, and in that the time interval between both signals (i) generated during the rotation of the yarn balloon are used for determining the diameter of the yarn balloon.

9. The method according to claim 8, characterized in that the absence of electric signals (i) during the operation of the workstation is interpreted as the absence of a yarn balloon at the workstation, and therefore as a broken yarn.

10. The method according to claim 8, characterized in that the arrangement of the sensor enables conclusions to be made regarding overlengths and/or equal tensions of the yarn.

* * * * *